US008745832B2

(12) United States Patent
Barrios et al.

(10) Patent No.: US 8,745,832 B2
(45) Date of Patent: Jun. 10, 2014

(54) WHEEL HUB REMOVER AND METHOD

(75) Inventors: Jose O. Barrios, Owatonna, MN (US); Cory Pleschourt, Northfield, MN (US); Todd Derby, Claremont, MN (US)

(73) Assignee: Bosch Automotive Service Solutions LLC, Warren, MI (US)

( * ) Notice: Subject to any disclaimer, the term of this patent is extended or adjusted under 35 U.S.C. 154(b) by 369 days.

(21) Appl. No.: 12/914,779

(22) Filed: Oct. 28, 2010

(65) Prior Publication Data

US 2012/0102704 A1 May 3, 2012

(51) Int. Cl.
*B25B 1/02* (2006.01)
*B25B 27/14* (2006.01)

(52) U.S. Cl.
USPC ..... 29/245; 29/257; 29/258; 29/259; 29/266; 269/143

(58) Field of Classification Search
USPC ..... 29/257, 259, 276, 245, 256, 258, 266, 29/267; 269/143, 249
See application file for complete search history.

(56) References Cited

U.S. PATENT DOCUMENTS 1,064,400 A * 6/1913 Timmins ..... 29/259
2,077,254 A * 4/1937 Nestler ..... 29/259
2,590,150 A * 3/1952 Brugmann ..... 29/245
3,402,455 A * 9/1968 Converse ..... 29/261
4,691,907 A * 9/1987 Yang ..... 269/152
5,067,220 A * 11/1991 Combs et al. ..... 29/259
5,735,033 A * 4/1998 Marugg ..... 29/254
6,012,211 A * 1/2000 Ochoa et al. ..... 29/426.5
6,123,326 A * 9/2000 Kleinbongartz ..... 269/215
6,357,097 B1 3/2002 Lundgreen et al.
6,581,265 B2 * 6/2003 Sawaya ..... 29/426.5
6,684,472 B2 * 2/2004 Abdelmoula et al. ..... 29/262
6,925,696 B1 * 8/2005 Williams ..... 29/252
7,520,041 B1 * 4/2009 Aguilar ..... 29/259
7,685,688 B2 * 3/2010 Fan ..... 29/259
7,770,277 B2 * 8/2010 Wridt ..... 29/261

(Continued)

OTHER PUBLICATIONS

Baum Tools Unlimited Inc., 50th Anniversary Edition, Volkswagen-Audi Tool Catalog 2009, p. VII, Axle and Hub Puller Kit, http://www.baumtools.com/; Copyright 2008 Baum Tools Unltd. Inc.

(Continued)

*Primary Examiner* — Essama Omgba
*Assistant Examiner* — Darrell C Ford
(74) *Attorney, Agent, or Firm* — Baker & Hostetler LLP

(57) ABSTRACT

A hub remover is provided. The hub remover includes a cross bar; a set of jaws having a receiving hole dimensioned to allow the cross bar to fit through the receiving hole to connect the jaws together via the cross bar; a forcing screw configured to extend through the cross-bar and between the jaws; a forcing screw nut configured to threadably engage an end of the forcing screw; and a resilient friction device located in the hole and configured to generate friction between the cross bar and the jaw when the cross bar moves through the hole in the cross bar. A method of operating a hub remover is provided. The method includes extending the forcing screw through a hole in the hub; placing a forcing screw nut on an end of the forcing screw that has extended through the hub; placing a foot portion of a jaw behind a portion of the hub; and turning the forcing screw to urge the forcing screw nut against a rear portion of the hub and thereby push the hub off of a spindle assembly.

19 Claims, 5 Drawing Sheets

(56) References Cited

U.S. PATENT DOCUMENTS

| | | | | |
|---|---|---|---|---|
| 8,177,209 | B2 * | 5/2012 | Chen | 269/236 |
| 8,266,776 | B2 * | 9/2012 | Dwileski, Jr. | 29/271 |
| 8,464,411 | B2 * | 6/2013 | Betcher et al. | 29/259 |
| 8,517,365 | B2 * | 8/2013 | Velez | 269/156 |
| 2004/0262182 | A1 * | 12/2004 | Myer et al. | 206/349 |
| 2008/0052892 | A1 * | 3/2008 | Dwileski, Jr. | 29/464 |
| 2008/0110007 | A1 * | 5/2008 | Hume | 29/244 |
| 2009/0139071 | A1 * | 6/2009 | Palka | 29/259 |
| 2011/0131783 | A1 * | 6/2011 | Betcher et al. | 29/426.5 |
| 2011/0133139 | A1 * | 6/2011 | Betcher et al. | 254/100 |

OTHER PUBLICATIONS

Honda/Acura Bushing X-Tractor Removal and Installation Tool, #65130, http://www.sptool.com/; Copyright 2011 SP Tools.

* cited by examiner

WHEEL HUB REMOVER AND METHOD

FIELD OF THE INVENTION

The present invention relates generally to a tool for maintaining a vehicle wheel. More particularly, the present invention relates to a wheel hub removal tool.

BACKGROUND OF THE INVENTION

Wheeled vehicles require regular maintenance. During some maintenance cycles, the wheel hub must be removed from the spindle assembly. This operation can require specialized tools in order to remove and replace the wheel hub from the spindle assembly. Various wheel hub remover tools have been used in the past. Some of the drawbacks associated with some of those tools include, inadequate stability of forces which may cause misalignment of the tool and cause the tool to fail to perform its intended function. Other tools may be very bulky and relatively difficult to adjust on the vehicle. This bulkiness and difficulty in adjustment may require two operators to install or remove components. The use of two operators is inefficient. It would be desired to require only a single operator to perform this function.

Wherefore it would be desired to have a tool that can perform functions such as removing or replacing wheel hubs on wheel hub apparatus that are relatively easy to use and can be operated by a single operator.

SUMMARY OF THE INVENTION

The foregoing needs are met, to a great extent, by the present invention, wherein in one aspect an apparatus is provided that in some embodiments a wheel hub remover is provided and is relatively easy to use and can be used to remove and/or replace a wheel hub on a wheel hub apparatus. A wheel hub remover is relatively easy to use and maybe operated by a single operator.

In accordance with one embodiment of the present invention, a hub remover is provided. The hub remover includes a cross bar; a set of jaws having a receiving hole dimensioned to allow the cross bar to fit through the receiving hole to connect the jaws together via the cross bar; a forcing screw configured to extend through the cross-bar and between the jaws; a forcing screw nut configured to threadably engage an end of the forcing screw; and a resilient friction device located in the hole and configured to generate friction between the cross bar and the jaw when the cross bar moves through the hole in the cross bar.

In accordance with another embodiment of the present invention, a method of operating a hub remover is provided. The method includes extending the forcing screw through a hole in the hub; placing a forcing screw nut on an end of the forcing screw that has extended through the hub; placing a foot portion of a jaw behind a portion of the hub; and turning the forcing screw to urge the forcing screw nut against a rear portion of the hub and thereby push the hub off of a spindle assembly.

In accordance with yet another embodiment of the present invention, a hub remover is provided. The hub remover may include a cross bar; a means for pulling having a receiving hole dimensioned to allow the cross bar to fit through the receiving hole to connect the means for pulling together via the cross bar; a means for pulling configured to extend through the cross-bar and between the means for pulling; a forcing screw nut configured to threadably engage an end of the forcing screw; and a means for creating friction located in the hole and configured to generate friction between the cross bar and the means for forcing when the cross bar moves through the hole in the cross bar.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions in so far as they do not depart from the spirit and scope of the present invention.

DETAILED DESCRIPTION

Figure 2:
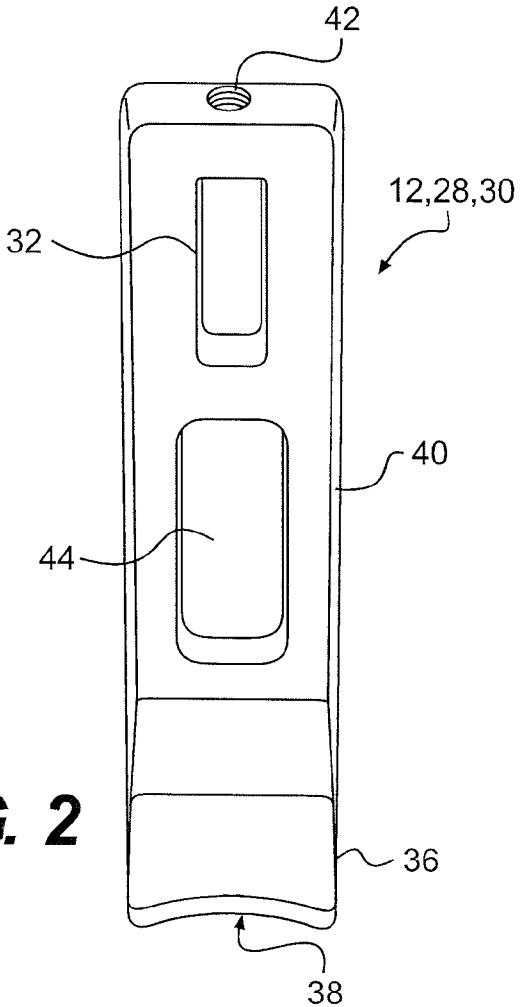
FIG. 2 is a perspective view of the interior portion of one of the jaws from the wheel hub remover shown in FIG. 1.

The invention will now be described with reference to the drawing figures, in which like reference numerals refer to like parts throughout. An embodiment in accordance with the present invention provides a tool for pulling a wheel hub off of a spindle assembly of vehicles such as cars or trucks.

Figure 1:
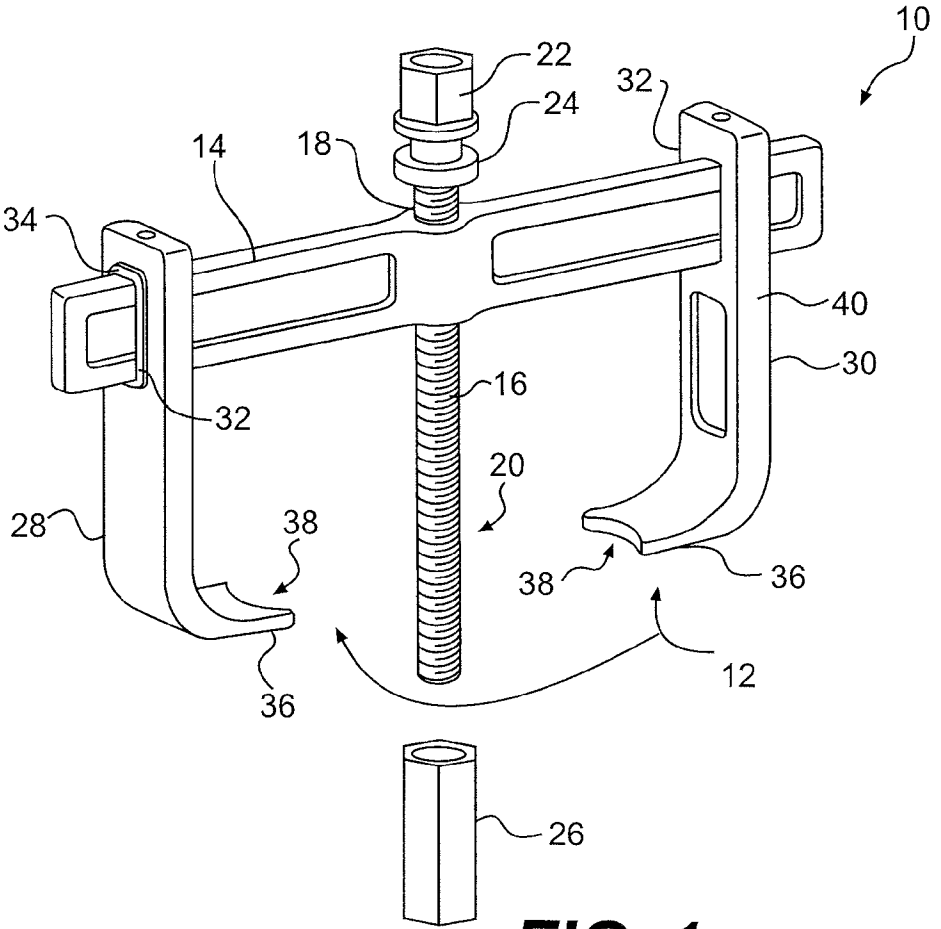
FIG. 1 is a perspective view illustrating a wheel hub remover in accordance with an embodiment of the invention.

FIG. 1 illustrates a puller tool 10 in accordance with one embodiment of the invention. The puller tool 10 include jaws 12. The tool jaws 12 can be identical to each other and assembled facing each other. In other embodiments of the invention, the jaws 12 may not be identical to each other. A forcing screw 16 extends through the crossbar 14 in a hole 18 in the crossbar 14. The hole 18 is not threaded in accordance with some embodiments of the invention and allows the forcing screw to spin freely in the hole 18. The forcing screw 16 may also include a bolt head 22. A bolt head 22 may be hexed shaped and may be configured to be turned by a socket, a wrench or any other suitable tool. Washers 24 may separate the bolt head 22 from the crossbar 14.

A forcing screw nut 26 has an interior hole with threads that communicate with the threads 20 located on the forcing screw 16. The forcing screw nut 26 may be hexed shaped as shown, in order to be turned by a wrench or any other suitable tool.

The jaws 12 may include a left jaw 28 and a right jaw 30. Each jaw 28, 30 may include a hole 32 in the jaw. The hole 32 allows the crossbar 14 to extend through the jaw 28, 30. A hole extension, boss or flange 34 may be located around the hole 32 in the jaw 28, 30. The hole extension, flange or boss 34 may allow force imparted from the crossbar 14 to the jaws 12 to be distributed over a larger area. The jaws 12 include a foot portion 36. The foot portion 36 includes a inner curved surface 38. The inner curve surface 38 may have a radius configured to correspond to a radius of a hub for which the puller tool 10 is used to pull off of a spindle assembly. The jaws 12 also include a leg portion 40.

Figure 3:
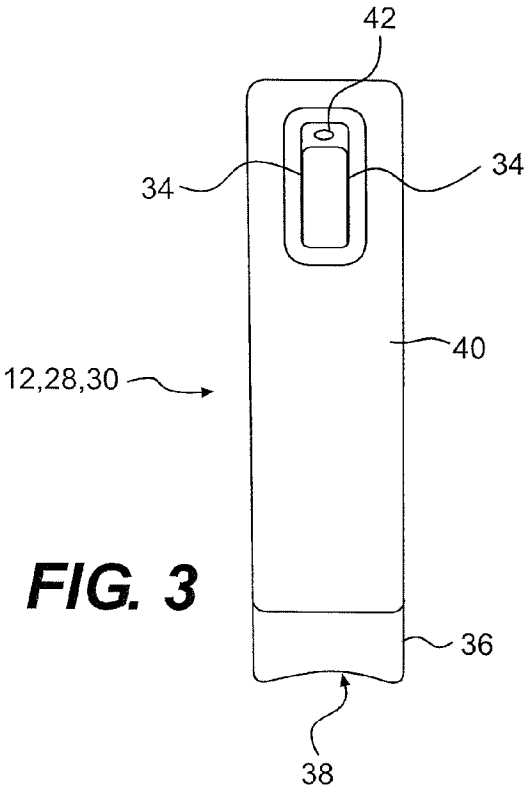
FIG. 3 is a perspective view of an outside portion of one of the jaws from the wheel hub remover shown in FIG. 1.

FIGS. 2 and 3 are side views of the left 28 and right 30 jaws. FIG. 2 shows an inner portion of the jaw 28, 30. FIG. 3 shows an outer portion of the jaw 28, 30. The jaws 12 include the hole 32 located on the leg portion 40. The foot portion 36 and the curve surface 38 can also be seen. In order to make the jaws 12 lighter, indentations 44 may be made in the jaws 12 by removing material or casting indentations in the jaws 12.

Figure 4:
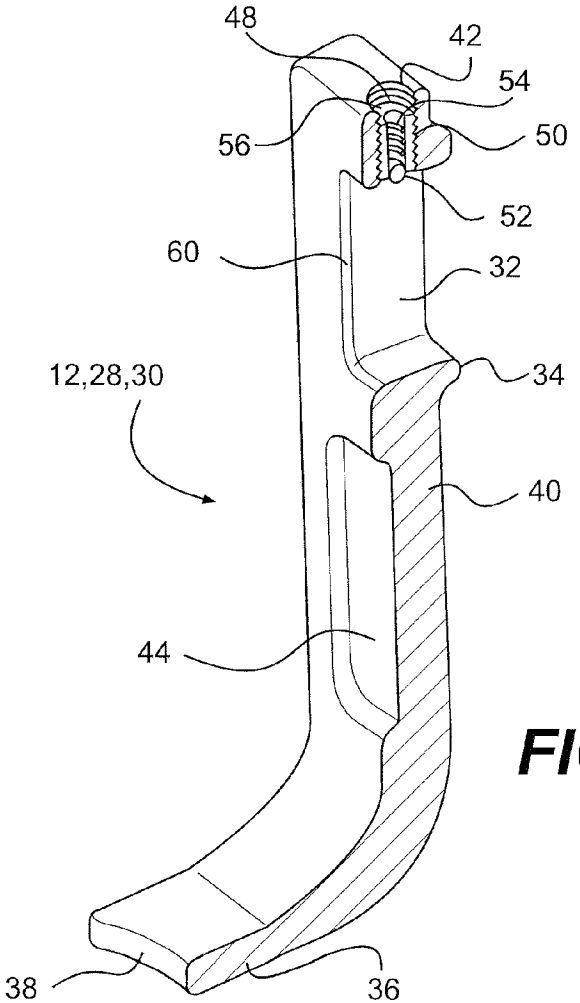
FIG. 4 is a perspective cross-sectional view of one of the jaws of the wheel hub remover shown in FIG. 1.

A plunger hole 42 is located in the hole 32. As shown in FIG. 4, a plunger 50 is located in the plunger hole 42. A plunger hole 42 may have threads 48 that correspond with threads 62 on the plunger 50.

The plunger 50 may include a spring loaded ball 52. The plunger 50 has a spring 54 that urges against an adjusting screw 56. The adjusting screw 56 can be turned with a screwdriver to provide more or less tension on the spring 54. Adjusting the screw 56 can thereby adjust the amount of force the spring loaded ball 52 applies to the crossbar 14. (The crossbar 14 is not shown in FIG. 4 in order to provide better clarity and less crowding in FIG. 4.)

According to some embodiments of the invention, the plunger 50 is part of the friction generating device that provides friction between the jaws 12, 28, 30 and the crossbar 14 by generating friction between the jaws 12, 28, 30 and the crossbar 14. When it is desired to move the jaws 12, 28, 30 along the cross bar 14, the friction can be overcome and the jaws 12, 28, 30 can be moved.

FIG. 4 is a perspective cross sectional view of a jaw 12, 28, 30 and shows the curved surface 38 and the foot portion 36 of the jaw 12, 28, 30. The indented portion 44 is also shown in the leg portion 40. The hole 32 in the jaw is shown with a hole extension, flange or boss 34. As shown in FIG. 4 and present in some embodiments of the invention, the hole 32 may have chamfered edges 60.

Figure 6:
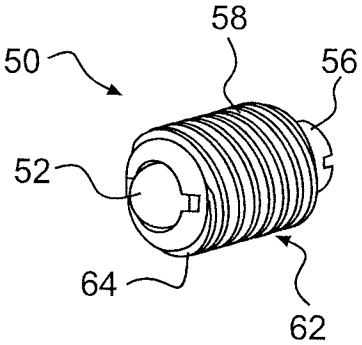
FIG. 6 is a perspective view of the friction generating device shown in FIG. 5.
Figure 7:
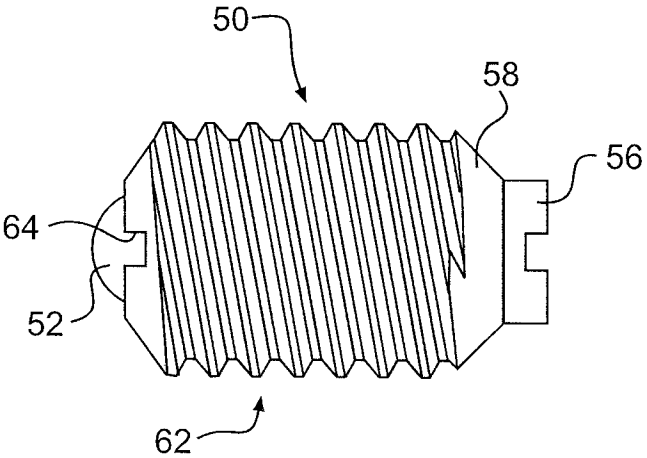
FIG. 7 is a perspective view of the friction generating device shown in FIGS. 5 AND 6.
Figure 5:
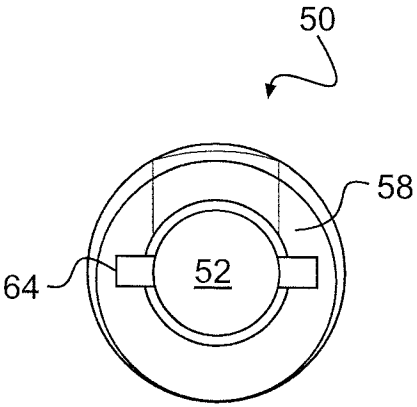
FIG. 5 is an end view of a friction generating device used in the jaws of the wheel hub remover as also shown in FIG. 4.

FIGS. 5, 6 and 7 are close up views of the plunger 50. FIG. 5 is an end view of the plunger 50 showing the spring loaded ball 52 located in the plunger body 58. A screw driver slot 64 as shown, allows the plunger 50 to be screwed into the plunger hole 42.

FIG. 6 is a perspective view of the plunger 50 showing the spring loaded ball 52, the adjusting screw 56 at the other end of the plunger body 58 from the spring loaded ball 52. The external threads 62 are shown as well as the screwdriver slot 64.

FIG. 7 is a side view of the plunger 50, illustrating the adjusting screw 56 and the threads 62 located in the plunger body 58. The spring loaded ball 52 and screw driver slot 64 are also shown. In some embodiments of the invention, the plunger 50 may be a standard off the shelf part of which a variety would work in accordance with embodiments of an invention. One example of a plunger 50 that may be used in accordance with the invention is sold by Fastenal Company of Winona Minn. and identified as part no. 0347992.

Figure 8:
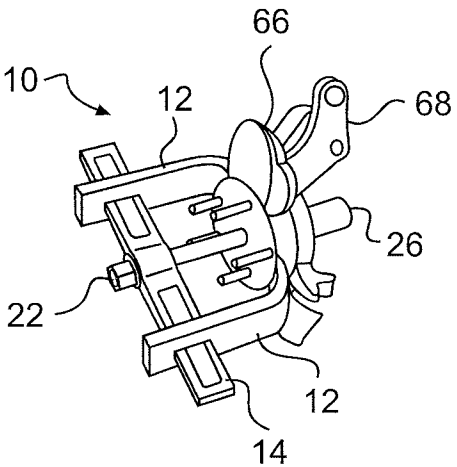
FIG. 8 is a perspective view of a wheel hub remover engaged with a wheel hub on a spindle assembly.

FIG. 8 is a perspective view of the puller tool 10 located against a hub 66 on a spindle assembly 68. A user may turn the bolt head 22 with a tool and hold the forcing screw nut 26 in place with a wrench or other suitable tool to pull the hub 66 off the spindle assembly 68. As the bolt head 22 is turned and the forcing screw nut 26 is held still, the forcing screw 16 draws the forcing screw nut 26 toward the bolt head 22. The bolt head 22 cannot move closer to the forcing screw nut 26 as the actual movement of the forcing screw 16 in a direction toward the hub 66 is prevented by the crossbar 14 and the jaws 12. Thus as the bolt head 22 and the forcing screw nut 26 are turned relative to each other in a tightening direction, the forcing screw nut 26 moves toward the bolt head 22 and urges the hub 66 to move off of the spindle assembly 68 from behind.

Figure 9:
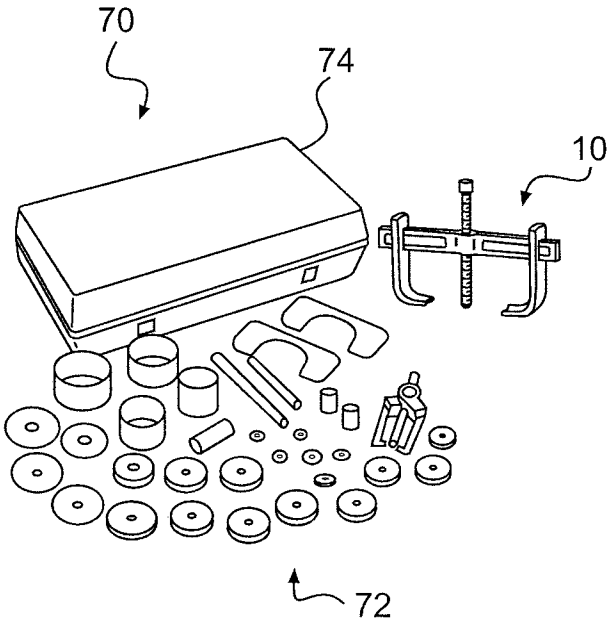
FIG. 9 is a perspective view of a wheel hub remover as a component of a kit of several tools which may be used in removing and replacing a wheel hub for a wheel hub apparatus.

FIG. 9 shows the puller tool 10 included as part of a kit 70. The kit has a variety of parts 72 that can be fit within a carrying case 74. In some of the embodiments of the invention the kit 70 may include parts such as tubes, a front wheel drive hub puller, bearing installers, a small adapter assembly, hex nuts, hex head screws, forcing screws, bearing installers, wheel hub installers, bearing removers, adapter sleeves, forcing nut screws, washers, braced puller adapters, outer tire rod removers, forcing screws, front hub installers and adapters used for various makes of automobiles. An example of parts that may be included in the kit 70 along with the hub puller 10, may be the product commonly sold as the HubTamer Elite identified by the OTC tool catalog number 6537 and Marketed and sold by the SPX Corporation of Charlotte, N.C. U.S. Pat. No. 6,357,097 incorporated herein by reference of its entirety describes using aspects of the HubTamer Elite.

Figure 10:
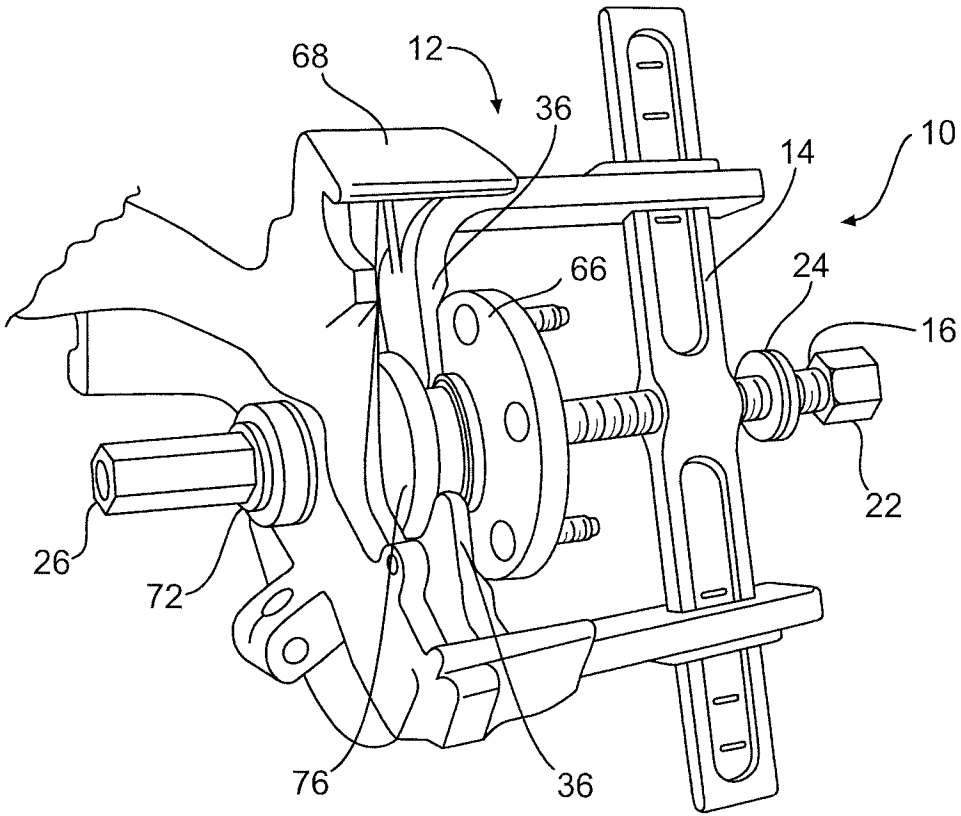
FIG. 10 is a perspective view of a wheel hub remover engage with a wheel hub on a spindle assembly.

Some of the kit 70 parts 72 may be used to remove a hub 66 from a spindle assembly 68. For example FIG. 10 shows a rear perspective view of a puller tool 10 removing a hub 66 from a spindle assembly 68. The bolt head 16 and washer 24 are shown to be spaced away from the crossbar 14 to better illustrate these features. However, under normal operation the bolt head 16 and the washer 14 are not spaced from the crossbar 14. The jaws 12 as positioned so that the foot portions 36 are behind the hub 66 and press against a solid portion 76 of the spindle assembly 68. A part 72 of the kit 70 may be placed on the forcing screw 16 between the forcing screw nut 26 and the spindle assembly 68 to spread the force generated by the forcing screw nut 26 in a desired way around the back of the hub 66. As the forcing screw 16 is turned in a tightening direction, the forcing screw nut 26 applies force (in some instances via a part 72) against the back of the hub 66 to remove the hub 66 from the spindle assembly 68.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A hub remover comprising:

a cross bar;

a set of jaws, each jaw having a receiving hole dimensioned to allow the cross bar to fit through the receiving hole to connect the set of jaws together via the cross bar;

a forcing screw configured to extend through the cross bar and between the set of jaws; and a resilient friction device including a spring-loaded ball located in a through hole positioned within the receiving hole in at least one of the jaws such that the spring loaded ball is at least partially received within the receiving hole and is configured to urge against the cross bar to generate friction between the cross bar and at least one jaw of said set of said jaws when the cross bar moves through the receiving hole, wherein the at least one jaw of said set of jaws is configured to move along the cross bar in an infinite number of positions.

2. The hub remover of claim 1, wherein the spring loaded ball forming part of the resilient friction device is contained within a housing configured to fit into the through hole.

3. The hub remover of claim 2 wherein the housing includes a screw driver slot that allows the housing to be screwed into the through hole.

4. The hub remover of claim 2 wherein the through hole is threaded and the housing has external threads that correspond with the threaded through hole.

5. The hub remover of claim 1, wherein the through hole is threaded.

6. The hub remover of claim 1, further comprising a rim around the receiving hole.

7. The hub remover of claim 1, wherein the jaws have a foot section and a leg section, the foot section is bent to a substantially right angle with respect to the leg section.

8. The hub remover of claim 7, wherein the foot section terminates with a curved surface.

9. The hub remover of claim 7, wherein the foot portion includes an inner curved surface.

10. The hub remover of claim 9, wherein the inner curved surface has a radius configured to correspond to a radius of a hub for which the hub remover is used to pull off a spindle assembly.

11. The hub remover of claim 1, further comprising a bolt head on an end of the forcing screw.

12. The hub remover of claim 11, further comprising a washer located on the forcing screw between the bolt head and the cross bar.

13. The hub remover of claim 11, wherein at least one of the bolt head and the forcing screw nut are hex shaped.

14. The hub remover of claim 1, having indentations.

15. The hub remover of claim 1, further including a kit of auxiliary tools configured to cooperate with the hub remover to remove and replace a hub.

16. The hub remover of claim 15, wherein the kit includes a carrying case.

17. The hub remover of claim 15, wherein the auxiliary tools include at least one of the following: a tube, a bearing installer, a washer, a hex nut, a hex head cap screw, an adapter, a wheel hub installer, a bearing remover, a sleeve, a small adapter assembly, a race puller adapter, an outer tie rod remover, and an adapter for a specific model of car.

18. The hub remover of claim 1 wherein the cross bar has an I shaped cross section.

19. The hub remover of claim 1 further comprising a forcing screw nut configured to threadably engage an end of the forcing screw.

* * * * *